United States Patent [19]

Bondpers

[11] Patent Number: 4,471,936

[45] Date of Patent: Sep. 18, 1984

[54] MOULD CORE FOR CASTING CONCRETE ELEMENTS

[75] Inventor: Per-Erik Bondpers, Växjö , Sweden

[73] Assignee: A-Betong AB/Sabema Material AB, Växjö , Sweden

[21] Appl. No.: 347,613

[22] Filed: Feb. 10, 1982

[30] Foreign Application Priority Data

Feb. 17, 1981 [SE] Sweden ..... 8101076

[51] Int. Cl.[3] ..... B22C 9/24

[52] U.S. Cl. ..... 249/152

[58] Field of Search ..... 264/318, 333, 334, 336; 249/63, 64, 142, 151, 160, 177, 178, 179, 180, 181, 152, 153

[56] References Cited

U.S. PATENT DOCUMENTS

| | | | |
|---|---|---|---|
| 929,694 | 8/1909 | Noah | 249/178 |
| 2,680,276 | 6/1954 | Filangeri | 249/64 |
| 3,814,374 | 6/1974 | Beemer | 249/152 |
| 3,952,990 | 4/1976 | Garcia | 249/180 |
| 4,125,246 | 11/1978 | von Holdt | 249/64 |
| 4,209,161 | 6/1980 | Horvath | 249/180 |

*Primary Examiner*—Donald Czaia
*Assistant Examiner*—Mary A. Becker
*Attorney, Agent, or Firm*—Sughrue, Mion, Zinn, Macpeak & Seas

[57] ABSTRACT

In the casting of a concrete element, such as a column support block, in which there is used a mould core designed to produce one or more recesses or grooves in the element, the mould core is provided with one or more apertures or slots, in each of which there is arranged a recess-forming mould part which can be moved in said aperture or slot by means of a ram. Prior to a casting operation, the moveable mould part is moved to an outwardly projecting active position and, subsequent to the cast element hardening, is withdrawn by means of the ram, thereby to enable the cast element and the mould core to be separated from one another. All of the moveable core parts on one side surface of the mould core can be arranged on a plate extending parallel to the corresponding side surface of the mould core and arranged to be acted upon by the ram.

The invention also relates to a mould core provided with apertures or slots for moveable mould parts, the mould parts being arranged for movement by means of a ram between an active, casting position and an inactive position in which the cast element can be removed from the mould core.

2 Claims, 5 Drawing Figures

Fig. 1
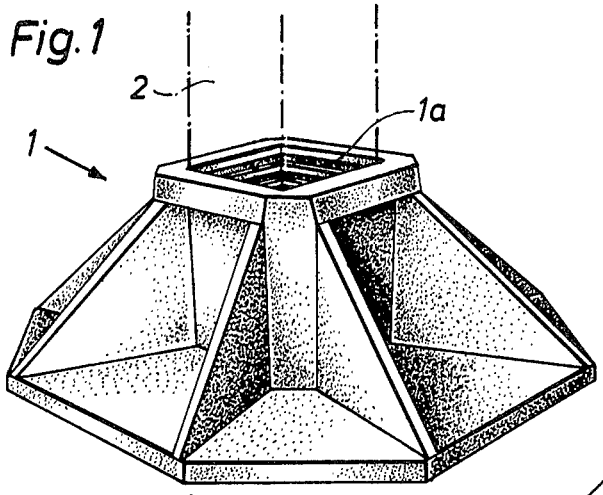
Fig. 2
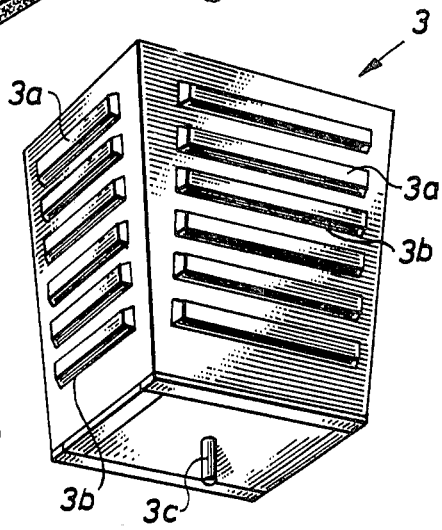
Fig. 3
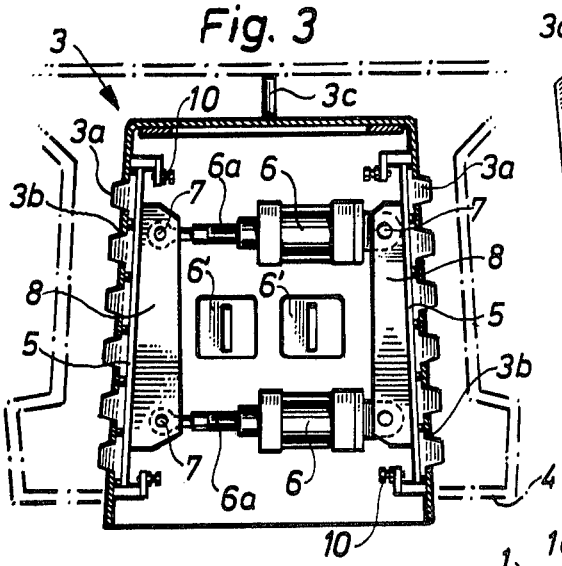
Fig. 4
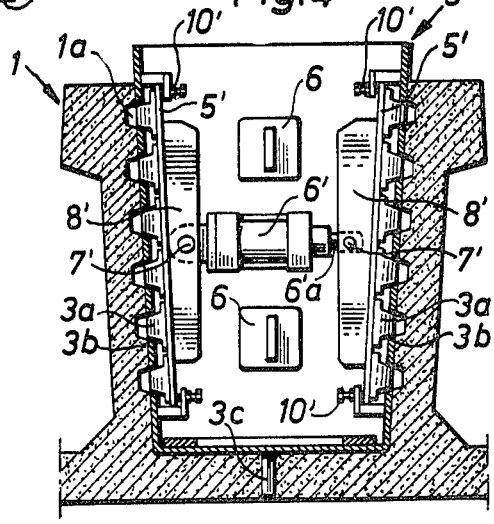
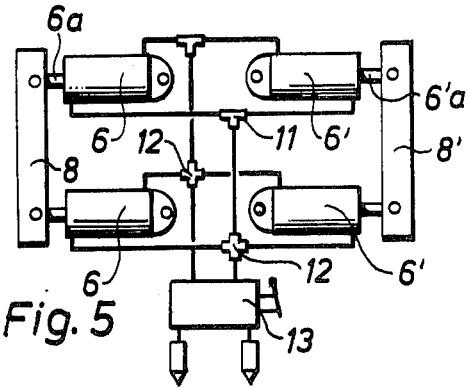
Fig. 5

MOULD CORE FOR CASTING CONCRETE ELEMENTS

FIELD OF INVENTION

The present invention relates to a method for casting concrete elements, for example column foundation blocks, in moulds while using a mould core designed to produce one or more recesses in the element and comprising the steps of providing the mould core with one or more apertures or slots in which a recessforming mould part can be moved, causing each moveable core part, prior to a casting operation, to take an active position in which it projects outwardly through a corresponding aperture, moving said core part to an inactive position subsequent to said casting operation and arranging all recess-forming mould parts on one side surface of the mould core on a plate located within the core and extending substantially parallel to said side surface.

BACKGROUND ART

When using mould cores known hitherto, the task of setting and stripping the mould is both complicated and time consuming. The cost of the moulds and associated mould cores is also high. Contributory hereto is, inter alia, the handling difficulties experienced as a result of the completely closed core space.

In an attempt to avoid these difficulties, one method proposes that the mould core is made of steel and supplemented with loose mould parts. In this way, it is possible to strip the steel core separately towards one free side, and to then loosen the remaining mould parts, which form the recesses in the cast concrete element, by forcing said parts inwardly into the free core space created when removing the steel core.

Even this method, however, requires doubling of the mould setting operations and time consuming, heavy work in difficulty reached spaces within the mould core. In addition, the loose mould parts must be cleaned and handled, which also means heavy and difficult work.

In U.S. Pat. No. 2,680,276 (Filangeri) there is described a cesspool mold of large dimensions including inner and outer sectional walls to provide a moulding space, i.e. there is no mould core like in the present invention. The inner wall sections are provided with tubular guides for core pins which are projectable across the moulding space to form drainage openings in the cesspool wall. When assembling the mould a workman enters through a manhole and connects a plate holding the core pins with a central post, so that it will be possible to displace the core pins from outside of the mould. The arrangement is complicated and expensive and possible to use only in very big moulds.

OBJECTS OF INVENTION

One object of the present invention is to provide a method of the aforementioned kind by which the disadvantages associated with known methods are avoided and which facilitates the manual work both when setting the mould and when stripping the same.

Another object of the invention is to provide a novel mould core which facilitates the task of mould setting and mould stripping when casting concrete, particularly in those cases when the cast element is provided with recesses.

BRIEF DESCRIPTION OF THE INVENTION

The method according to the invention is mainly characterized by moving said plate towards and away from said side surface in a direction substantially at right angles thereto by means of a ram mounted within the core.

One or more rams arranged in the interior of the mould core, said rams suitably comprising pneumatic or hydraulic piston-cylinder devices or the like, facilitate the handling of the loose mould parts and may cause a plurality of mould parts to be displaced simultaneously on mutually opposing side surfaces of the mould core, thereby facilitating the operation.

Stop means are suitably provided for limiting the inward movement of the core part or parts towards said inactive position.

Above all, the invention affords the important advantage of enabling those mould parts which form flutes or recesses in the cast concrete element to be stripped from the mould together with the actual mould core, the stripping operation being facilitated by the fact that relative displacement of the mould core and the wall of the cast concrete element can be effected parallel with the said wall.

The invention also relates to a mould core for use when carrying out the aforedescribed method, the main characterizing features of the mould core being set forth in the following claims.

A mould core of the aforementioned kind is particularly useful with moulds for manufacturing so-called column foundation boxes, i.e. a foundation on which columns or pillars can be mounted. In this respect, the flutes or openings in the cast column foundation block are necessary for transferring horizontal and vertical forces in the column to the foundation. This transfer of forces is effected through a concrete layer cast between the foundation block and the column.

An embodiment of the invention will now be described in more detail with reference to the accompanying drawing.

BRIEF DESCRIPTION OF THE DRAWINGS

FIG. 1 is a perspective view of a so-called column foundation block manufactured by means of the method according to the invention, and a column associated with said foundation block.

FIG. 2 is a perspective view of a mould core for use when carrying out the method according to the invention.

FIG. 3 is a sectional view of a mould core according to FIG. 2, arranged in a mould, shown in chain lines, with the recess-forming core parts in an active (casting) position.

FIG. 4 is a sectional view of a mould core according to FIG. 2, and a cast column foundation block during stripping of the mould core, the recess-forming parts of the mould being shown in their inactive (stripping) position which is inverted from the active (casting) position of FIG 3.

FIG. 5 illustrates the operational mode of the pneumatic cylinders and piston rods which act upon the moveable core parts.

DESCRIPTION OF PREFERRED EMBODIMENT

FIG. 1 illustrates a so-called column foundation block 1, i.e. a foundation support for mounting a column 2. In order to ensure that the horizontal and vertical forces acting in the column are reliably transferred to the column foundation block, the block has a central inner, tapering fluted portion 1*a*.

The spaces between the ridges of the flutes are called here recesses and are produced by separate, outwardly projecting core parts or sections 3*a* of a mould core 3 illustrated in FIG. 2. The core mould is used to form the central opening 1*a* in the column foundation block 1 when casting said block in a mould 4 shown in chain lines in FIG. 3. The reference 3*c* identifies a pin for forming a drainage hole in the cast foundation block (see FIG. 4).

Each of the side surfaces of the mould core 3 has a number of openings or slots 3*b* in which the recess-forming mould parts 3*a* are arranged for movement between an active, outwardly projecting position shown in FIGS. 2 and 3, and in inactive position, shown in FIG. 4, in which said mould parts are partially withdrawn into the mould core. These side surfaces of core 3 form directly with mould 4 the casting space.

In the illustrated embodiment, all moveable core parts 3*a* located adjacent one side surface of the mould core 3 are arranged on a plate 5. The plate 5 is acted upon by two pneumatic cylinders 6 having associated piston rods 6*a* which are pivotally connected to the plate 5 through pivot pins 7. The pivot pins are accommodated in holder strips 8 extending at right angles to the surface of the plate.

In a similar manner, the piston rod 6*a* of the cylinders are connected via pivot pin 7 and holder strip 8 to a plate 5 located on the opposite side surface of the mould core 3, this latter plate 5 also carrying moveable core parts 3*a*.

As illustrated in FIG. 3, the mould core is arranged in a mould 4, shown in chain lines.

As illustrated in FIG. 4, other moveable core parts 3*a* located on two mutually opposing sides of the mould core are arranged for movement between an active and an inactive position, by means of plates 5', pivot pins 7', holder strips 8' and pneumatic cylinders 6' with associated piston rods 6'*a*. In this case, the two cylinders 6' are located on the same level in the interior of the mould core 3 and between the cylinders 6 extending at right angles to the axis of the cylinders.

FIG. 4 shows the moveable core parts 3*a* withdrawn to their inactive positions, in which stripping from a cast column foundation block 1 can readily be effected, by drawing the mould core 3 upwardly so as to separate it from the foundation block 1, the mould core being inverted from its FIG. 3 orientation for this separating or stripping operation.

Adjustable stop means 10, 10' are arranged to restrict the inward movement of the moveable core parts 3 to their inactive postions under the action of respective cylinder 6, 6'.

FIG. 5 is a diagram showing how the cylinders 6, 6' and associated piston rods are controlled. By using T-couplings and cruciform couplings 11 and 12 respectively, all four cylinders and associated piston rods are activated simultaneously, enabling all moveable mould parts 3*a* to be moved simultaneously to an active or inactive position by simple manipulation of an operating device 13.

When casting a column foundation block, the mould core 3 is placed in a mould 4, it being ensured that the moveable mould parts 3*a* take an active position. Concrete is then poured into the mould and allowed to harden while being vibrated. The mould is then stripped, it being assumed here that FIG. 4 illustrates that the outer mould walls of the mould 4 have been removed, so that only the column foundation block 1 and the mould core 3 remain. The moveable mould parts 3*a* are moved to their respective inactive positions by means of the rams 6, 6*a*, 6', 6'*a*, whereafter the mould core can be readily separated from the column foundation block.

The invention thus saves time and expense, since mould setting and stripping can be effected in one working operation, and that all the work can be carried out mechanically. Heavy handling of loose mould sections is completely avoided.

Instead of the illustrated pneumatic operating devices, it is possible to use other types of rams, for example screw jacks or the like.

The principle of the invention can be applied in many other contexts where the cast concrete element is to be provided with ruffles.

I claim:

1. A rigid mould core for insertion in a mould for casting a concrete element with a central cavity therein and forming flutes in the wall of the cavity of the concrete element, said mould core comprising a stationary rigid side surface which is directly engageable with the cavity wall, which forms directly with said mould a casting space, and which is provided with an aperture in which a mould part, which forms a recess in the cavity wall of the cast element, is moveable between an outward active casting position and an inward inactive position in which the cast element can be removed from the mould core, moveable plate means mounted inside said core and adjacent and substantially parallel to said stationary side surface for movement relative thereto, a mould part mounted on said plate means and projecting through said aperture and outwardly from said side surface in said active position for a distance less than the thickness of the cavity wall, and ram means mounted within the mould core for displacing said plate means towards and away from the apertured side surface, in a direction substantially perpendicular thereto, to said active and inactive positions, respectively.

2. A mould core according to claim 1 wherein said core has two pairs of mutually opposing stationary rigid side surfaces, each of which is directly engageable with the cavity wall and each of which is provided with an aperture, said plate means comprises a plate adjacent each side surface, and said ram means comprises a ram connected between opposing plates for simultaneously moving all of the plates between said active and inactive positions.

* * * * *